US008687036B2

(12) United States Patent
Ishida et al.

(10) Patent No.: US 8,687,036 B2
(45) Date of Patent: Apr. 1, 2014

(54) LIGHT SOURCE DRIVER, LIGHT SOURCE DEVICE, LIGHT SCANNING DEVICE AND IMAGE FORMING APPARATUS

(75) Inventors: Masaaki Ishida, Yokohama (JP); Atsufumi Omori, Chigasaki (JP); Jun Tanabe, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 1322 days.

(21) Appl. No.: 12/126,265

(22) Filed: May 23, 2008

(65) Prior Publication Data

US 2008/0298842 A1 Dec. 4, 2008

(30) Foreign Application Priority Data

May 28, 2007 (JP) ..... 2007-141023

(51) Int. Cl.
*B41J 2/435* (2006.01)
*B41J 2/47* (2006.01)

(52) U.S. Cl.
USPC ..... 347/247; 347/237

(58) Field of Classification Search
USPC ..... 347/237, 247
See application file for complete search history.

(56) References Cited

U.S. PATENT DOCUMENTS

| | | | | |
|---|---|---|---|---|
| 6,262,758 | B1 * | 7/2001 | Suzuki et al. | 347/237 |
| 6,649,832 | B1 * | 11/2003 | Brophy et al. | 174/535 |
| 6,791,596 | B2 | 9/2004 | Nihei et al. | |
| 6,853,396 | B1 * | 2/2005 | Omae | 347/237 |
| 6,933,957 | B2 | 8/2005 | Omori et al. | |
| 7,256,815 | B2 | 8/2007 | Suzuki et al. | |
| 7,271,824 | B2 | 9/2007 | Omori et al. | |
| 2004/0124835 | A1 | 7/2004 | Kimura | |
| 2005/0243163 | A1 | 11/2005 | Ozasa et al. | |
| 2006/0285186 | A1 | 12/2006 | Ishida et al. | |
| 2007/0030548 | A1 | 2/2007 | Nihei et al. | |
| 2007/0091163 | A1 | 4/2007 | Omori et al. | |
| 2007/0132828 | A1 | 6/2007 | Ishida et al. | |
| 2008/0088893 | A1 | 4/2008 | Ishida et al. | |

FOREIGN PATENT DOCUMENTS

| | | |
|---|---|---|
| JP | 2000-12973 | 1/2000 |
| JP | 2002-217488 | 8/2002 |
| JP | 2002-314191 | 10/2002 |
| JP | 2004-119517 | 5/2004 |

OTHER PUBLICATIONS

Japanese official action dated Sep. 11, 2012 in corresponding Japanese patent application No. 2007-141023.

* cited by examiner

*Primary Examiner* — Uyen Chau N Le
*Assistant Examiner* — John M Bedtelyon
(74) *Attorney, Agent, or Firm* — Cooper & Dunham LLP

(57) ABSTRACT

A light source driver mounted on a rectangular-shaped substrate includes a plurality of output parts that output driving signals to drive a plurality of light-emitting bodies. The plurality of output parts are disposed in a vicinity of the two sides of the substrate, the two sides of the substrate forming a corner of the substrate.

8 Claims, 11 Drawing Sheets

$\tau 1 = R1 \times C1$
$\tau 2 = R2 \times C2$
$\tau 3 = R3 \times C3$

IN THE CASE THE LENGTH OF L1 <
THE LENGTH OF L2 < THE LENGTH OF L3

LIGHT SOURCE DRIVER, LIGHT SOURCE DEVICE, LIGHT SCANNING DEVICE AND IMAGE FORMING APPARATUS

PRIORITY CLAIM

This application is based on and claims priority from Japanese Patent Application No. 2007-141023, filed with the Japanese Patent Office on May 28, 2007, the contents of which are incorporated herein by reference in their entirety.

BACKGROUND OF THE INVENTION

1. Field of the Invention

The present invention relates to a light source driver, a light source device, a light scanning device and an image forming apparatus; more specifically, it relates to a light source driver that outputs driving signals to drive a plurality of light-emitting bodies, a light source device having the light source driver, a light-scanning device having the light source device and an image-forming apparatus including the light-scanning device.

2. Description of the Related Art

In image recording of electronic photography, an image-forming apparatus using a laser is widely used. In this case, the image-forming apparatus includes a light-scanning device, and a method to scan a surface to be scanned with laser beams using a polygon scanner (for example, a polygon mirror) in an axial direction of a photosensitive drum while rotating the drum to form a latent image is commonly used. In the field of electronic photography as such, in order to improve image quality and operability, an image having higher density and high-speed image output is required from the image-forming apparatus.

Therefore, a method to simultaneously scan a plurality of adjacent lines using a plurality of light beams is proposed.

For example, in JP2000-012973A, an image-forming apparatus having light-emitting elements each including a first electrode and a second electrode is disclosed. The light-emitting elements are disposed two-dimensionally within a long-shaped area and each light-emitting element includes a first wiring line that is connected to the first electrode and a second wiring line that is connected to the second electrode. The first wiring lines as row wiring lines formed in a long side direction and the second wiring lines as column wiring lines formed in a short side direction are connected in a matrix shape to form a light-emitting element array. The light-emitting element array disposed two-dimensionally is divided into a plurality of blocks, each of which is capable of independently driving. The row wiring lines and the column wiring lines are applied to each block of the light-emitting element array. Pull-out lines are pulled out from the row wiring lines in the column direction.

In addition, in JP2002-314191A, a light-emitting element array including a plurality of light-emitting elements disposed on a base substrate, a plurality of electrode pads disposed on the base substrate and a plurality of wiring lines that individually connect between the plurality of light-emitting elements and the plurality of electrode pads is disclosed. In the light-emitting element array, the floating capacitance of the plurality of wiring lines is approximately the same.

Incidentally, in recent years, it is known that a surface light-emitting laser element may be used as a light source of an image-forming apparatus.

For example, in JP2002-217488A, a surface light-emitting laser element including a multiple quantum well structure part between an active layer and a pair of distributed Bragg reflectors disposed to face each other via the active layer is disclosed. In the surface light-emitting laser element, a first electrode to apply a current to the active layer and a second electrode to apply an electric field to the multiple quantum well structure part are independently disposed. The surface light-emitting laser element has variable oscillation wavelength and changes a refractive index of the multiple quantum well structure part by applying an electric field to the multiple quantum well structure part through the second electrode. In the surface light-emitting laser element, GaInNAs mixed crystal is used as a material for a well layer of the multiple quantum well structure part.

In recent years, an image-forming apparatus has been used in simplified printing as an on-demand printing system and accompanying that, an image-forming apparatus of low price and superior image quality is required.

SUMMARY OF THE INVENTION

An object of the present invention is to provide a light source driver that can control a variation in length of the plurality of wiring lines which electronically connect between a plurality of light-emitting bodies and a plurality of output parts without incurring an increase in cost.

To accomplish the above object, a light source driver according to one embodiment of the present invention is mounted on a rectangular-shaped substrate, and includes a plurality of output parts that output driving signals to drive a plurality of light-emitting bodies. The plurality of output parts are disposed in the vicinity of the two sides of the substrate, the two sides of the substrate forming a corner of the substrate.

DETAILED DESCRIPTION OF THE PREFERRED EMBODIMENTS

Figure 1:
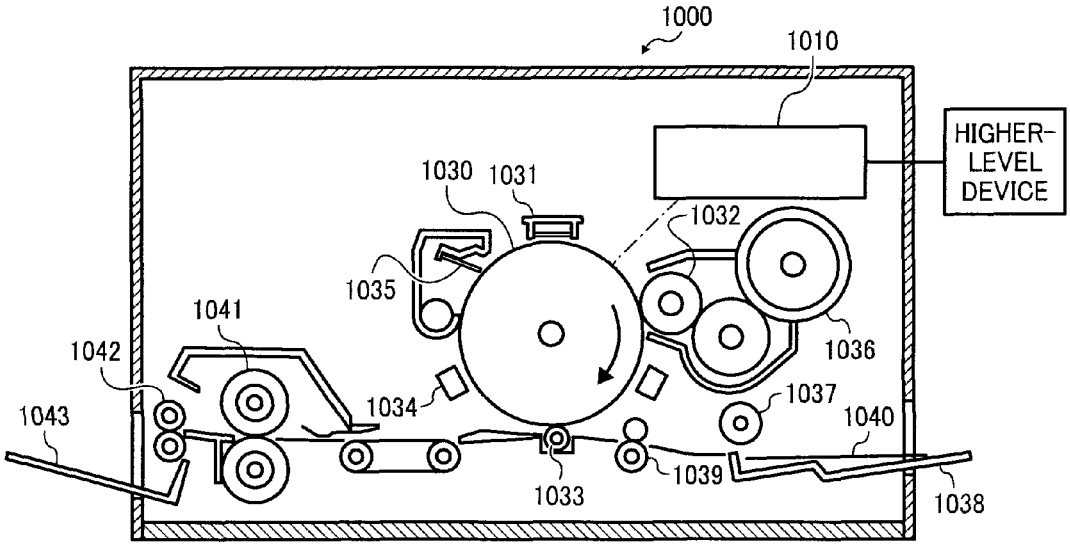
FIG. 1 is a diagram illustrating an approximate constitution of a laser printer according to an embodiment of the present invention.

Preferred embodiments of the present invention will be explained in detail hereinafter with reference to the accompanying drawings. As shown, for example, in FIGS. 9 to 11, a light source driver 14B according to an embodiment of the present invention is mounted on a rectangular-shaped substrate P400 and includes a plurality of output parts out01 to out32 that output driving signals to drive a plurality of light-emitting bodies v1 to v32, respectively. The plurality of output parts out01 to out32 are disposed in the vicinity of two sides of the substrate P400, the two sides of the substrate P400 forming a corner of the substrate. The light source driver according to an embodiment of the present invention can be used, for example, in an image-forming apparatus such as a laser printer. A schematic structure of a laser printer 1000 as an image-forming apparatus using a light source driver 14B according to one embodiment of the present invention is illustrated in FIG. 1. The printer 1000 includes at least one image carrier such as a photoreceptor 1030, at least one light-scanning device 1010 including the light source driver 14B according to an embodiment of the present invention, which scans the photoreceptor with light in which image information is contained. The light-scanning device 1010 further includes a deflector that deflects light from the light source device, and a scan optical system that collects the light deflected by the deflector on the surface to be scanned.

The laser printer 1000 further includes an electrostatical charger 1031, an image development roller 1032, a transfer charger 1033, a neutralization unit 1034, a cleaning blade 1035, a toner cartridge 1036, a paper-feeding roller 1037, a paper-feeding tray 1038, a pair of resist rollers 1039, a fixing roller 1041, a paper-discharging roller 1042 and a paper-discharging tray 1043 and so on.

A photosensitive layer is formed on a surface of the photoreceptor drum 1030. That is, the surface of the photoreceptor drum 1030 is a surface to be scanned. Hereby, the photoreceptor drum 1030 is rotated in a direction of an arrow in FIG. 1.

The electrostatical charger 1031, the image development roller 1032, the transfer charger 1033, the neutralization unit 1034 and the cleaning blade 1035 are respectively disposed in the vicinity of the surface of the photoreceptor drum 1030 in the order of the electrostatical charger 1031, the image development roller 1032, the transfer charger 1033, the neutralization unit 1034, and then the cleaning blade 1035 with regard to a rotation direction of the photoreceptor drum 1030.

The electrostatical charger 1031 uniformly charges the surface of the photoreceptor drum 1030.

A light-scanning device 1010 irradiates light modulated based on image information from a higher-level device (for example, a personal computer) onto the surface of the photoreceptor drum 1030 charged by the electrostatical charger 1031. Thereby, a latent image corresponding to the image information is formed on the surface of the photoreceptor drum 1030. The formed latent image moves in a direction directed toward the image development roller 1032 accompanying a rotation of the photoreceptor drum 1030. A constitution of the light-scanning device 1010 is described later.

Toner is stored in the toner cartridge 1036, and the toner is supplied to the image development roller 1032.

The image development roller 1032 visualizes the image information by adhering the toner supplied from the toner cartridge 1036 to the latent image formed on the surface of the photoreceptor drum 1030. The latent image on which the toner is adhered (for convenience, referred to as "toner image" hereinbelow) is moved in a direction directed toward the transfer charger 1033 accompanying the rotation of the photoreceptor drum 1030.

Recording paper 1040 is stored in the paper-feeding tray 1038. The paper-feeding roller 1037 is disposed in the vicinity of the paper-feeding tray 1038. The paper-feeding roller 1037 takes out the recording paper 1040 from the paper-feeding tray 1038 sheet by sheet and delivers it to the resist roller pair 1039. The resist roller pair 1039 is disposed in the vicinity of a transfer roller 911, retains once the recording paper 1040 taken out by the paper feeding roller 1037 and sends out the recording paper 1040 to a gap formed between the photoreceptor drum 1030 and the transfer charger 1033 in association with the rotation of the photoreceptor drum 1030.

Voltages of a reverse polarity to the toner are applied to the transfer charger 1033 in order to electrically attract the toner applied on the surface of the photoreceptor drum 1030 to the recording paper 1040. By means of the voltages, a toner image formed on the surface of the photoreceptor drum 1030 is transferred to the recording paper 1040. The transferred recording paper is sent to the fixing roller 1041.

In the fixing roller 1041, heat and pressure are applied to the recording paper 1040 so that the toner is fixed onto the recording paper 1040. The recording paper on which the toner is fixed is sent to the paper-discharging tray 1043 via the paper-discharging roller 1042 and sequentially stacked onto the paper-discharging tray 1043.

The neutralization unit 1034 removes the electricity on the surface of the photoreceptor drum 1030.

The cleaning blade 1035 removes the toner (residual toner) remaining on the surface of the photoreceptor drum 1030. The removed residual toner is used once again. The surface of the photoreceptor drum 1030 where the residual toner is removed goes back to the position of the electrostatical charger once again.

Next, a constitution of the light-scanning device 1010 is described. In the present specification, a Y axial direction is defined as a longitudinal direction of the photoreceptor drum 1030 and an X axial direction and a Z axial direction are defined as directions mutually orthogonal within surfaces perpendicular to the Y axial direction.

Figure 2:
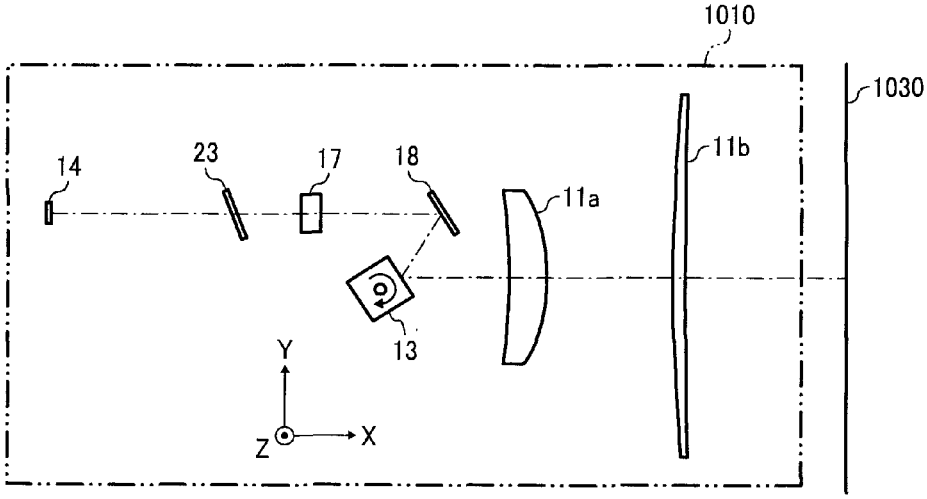
FIG. 2 is a diagram illustrating an approximate constitution of a light-scanning device of FIG. 1.

The light-scanning device 1010, as an example shown in FIG. 2, includes a light source unit 14, an opening plate 23, a cylindrical lens 17, a reflective mirror 18, a polygon mirror 13 as a deflector, a scan lens 11*a* disposed near the deflector and a scanning lens 11*b* disposed near an image plane and so on.

Figure 3:
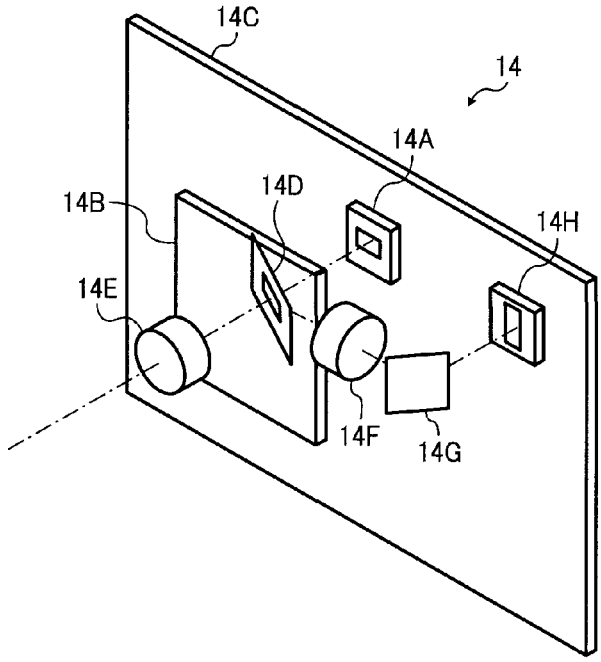
FIG. 3 is a diagram illustrating a light source unit of FIG. 2.

The light source unit 14, as an example shown in FIG. 3, includes a light source 14A, a control circuit 14B, a PCB (Printed Circuit Board) 14C, an opening plate 14D, a coupling lens 14E, a condensing lens 14F, a reflecting mirror 14G and a light-receiving element 14H.

Figure 4:
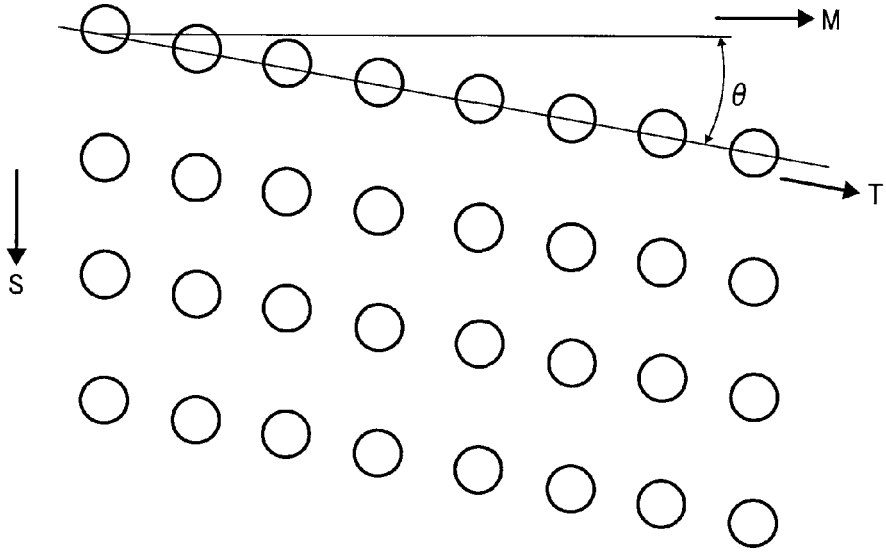
FIG. 4 is a diagram illustrating an arrangement of a plurality of light-emitting parts.

The light source 14A, as an example shown in FIG. 4, includes a two-dimensional array of vertical cavity surface emitting semiconductor lasers (VCSELs), in which 32 light-emitting parts are formed on a quadrangular-shaped substrate.

The two-dimensional array has four light-emitting part columns each including eight light-emitting parts disposed at equal intervals along a direction inclining with an angle of θ (for convenience, referred to as a T direction hereinbelow) in relation to a main scanning direction (for convenience, referred to as an M direction hereinbelow) towards a direction corresponding to a sub-scanning direction (for convenience, referred to as an S direction hereinbelow). And the four light-emitting part columns are disposed at equal intervals in the S direction. That is, 32 light-emitting parts are arranged two-dimensionally along the T direction and the S direction. Hereby, for convenience, the four light-emitting part columns are respectively referred to as a first-light emitting part column, a second light-emitting part column, a third light-emitting part column and a fourth light-emitting part column from the top to the bottom of the page space of FIG. 4. In the present specification, a "light-emitting part interval" is a distance between the centers of two light-emitting parts.

Figure 5:
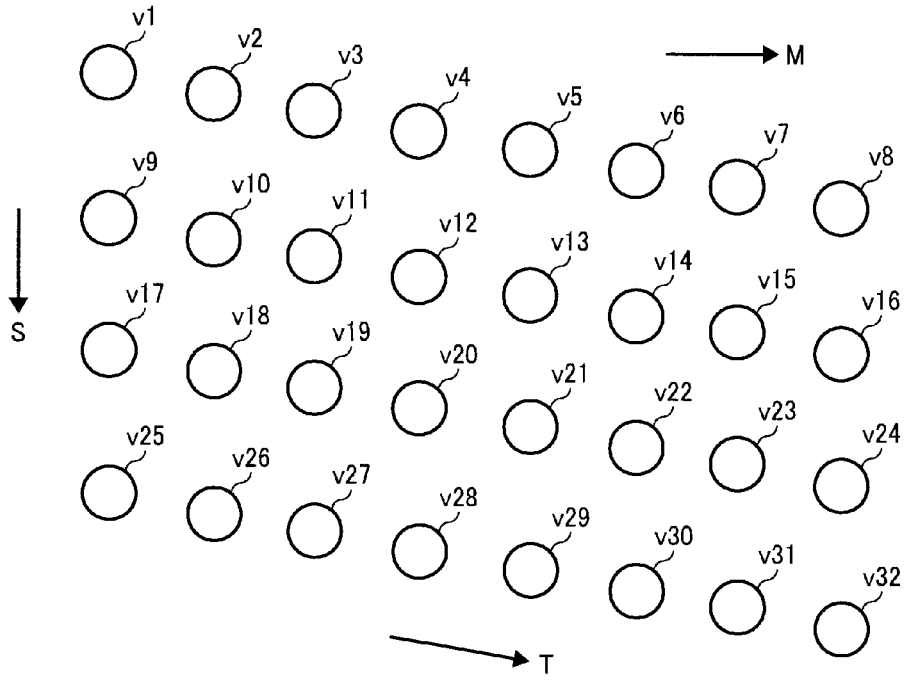
FIG. 5 is a diagram illustrating the light-emitting parts v1 through v32.

In addition, in order to specify each light-emitting part, for convenience, as shown in FIG. 5, from the upper left to the lower right of the page space of FIG. 5, the eight light-emitting parts that constitute the first-light emitting part column are referred to as v1 through v8, the eight light-emitting parts that constitute the second light-emitting part column are referred to as v9 through v16, the eight light-emitting parts that constitute the third light-emitting part column are referred to as v17 through v24, the eight light-emitting parts that constitute the fourth light-emitting part column are referred to as v25 through v32.

Figure 6A:
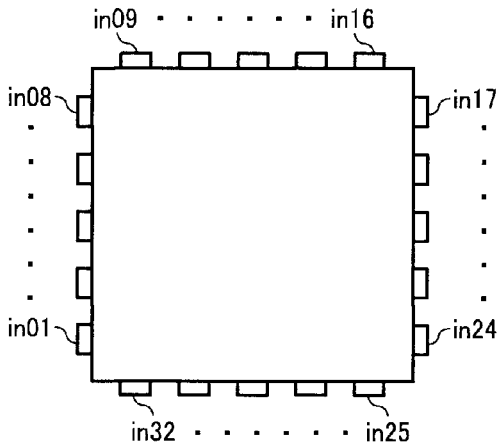
FIG. 6A and FIG. 6B are diagrams illustrating a light source package.
Figure 6B:
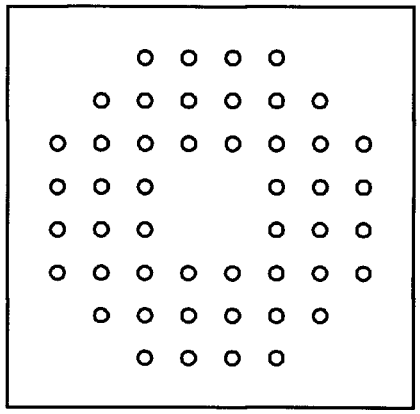

The two-dimensional array or the substrate, as shown in FIG. 6A as an example, is contained in a package of a QFP (Quad Flat Package) type. Terminals in01 through in32 of FIG. 6A corresponding to light-emitting parts v1 through v32, respectively, are input terminals to which the respective driving signals are inputted. The two-dimensional array, as shown in FIG. 6B as an example, can be contained in a package of a BGA (Ball Grid Array) type. For convenience, a package in which the two-dimensional array is contained is also referred to as a "light source package" hereinbelow.

Referring back to FIG. 3, the opening plate 14D is disposed so as to separate a portion of light emitted from the light source 14A as light for monitoring. The opening plate 14D has an opening part and a reflecting surface, is disposed on an optical path of the light emitted from the light source 14, which is oblique in relation to a virtual plane perpendicular to a traveling path of the light. A large portion of the light emitted from the light source 14 passes the opening part of the opening plate 14D, and the light reflected by the reflecting surface of the opening plate 14D becomes the light for monitoring.

The coupling lens 14E turns the light that has passed through the opening part of the opening plate 14D into approximately parallel light. Therefore, approximately parallel light is outputted from the light source unit 14.

The light reflected by the reflective surface of the opening plate 14D is captured by the condensing lens 14F and received by the light-receiving element 14H via the reflecting mirror 14G. The light-receiving element 14H outputs signals (photoelectric conversion signals) corresponding to light receiving quantity. The output signals of the light-receiving element 14H are used to monitor the light amount of the light emitted from the light source 14A, and based on the monitoring results, the driving current of each light-emitting part is complemented.

Figure 7:
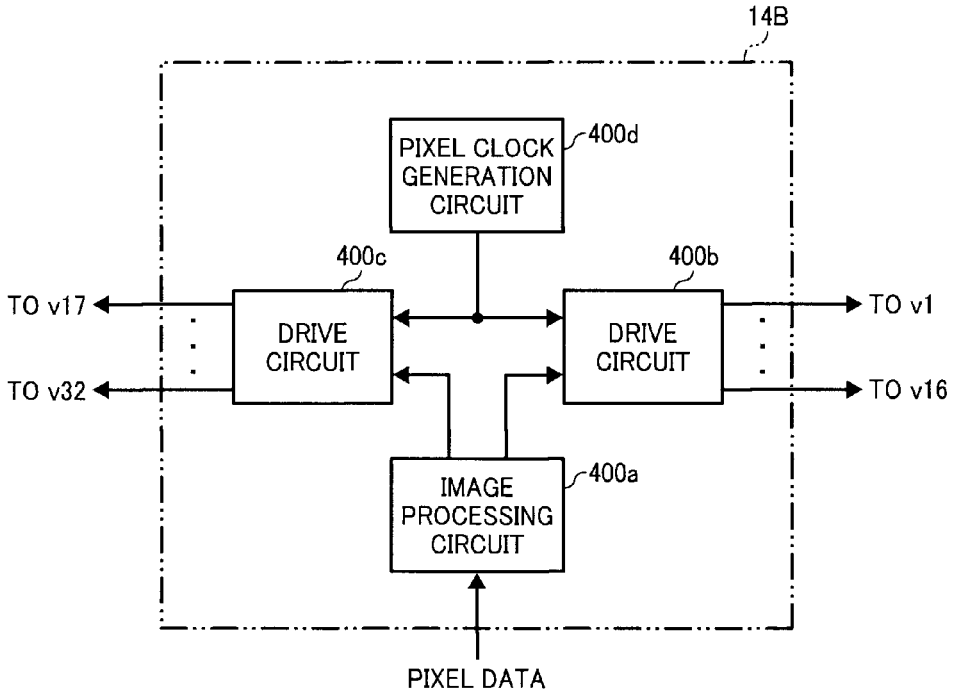
FIG. 7 is a block diagram illustrating a control circuit of a light source unit.

The control circuit 14B, shown in FIG. 7 as an example, includes an image processing circuit 400*a*, two drive circuits (400*b*, 400*c*) and a pixel clock generation circuit 400*d*.

The pixel clock generation circuit 400*d* generates a pixel clock signal, which is a standard clock of light scanning.

The image processing circuit 400*a*, after performing prescribed halftone processing against raster developed image data, supplies data with regard to the light-emitting part v1 through v16 to the drive circuit 400*b* and supplies data with regard to the light-emitting part v17 through v32 to the drive circuit 400*c*.

Figure 8A:
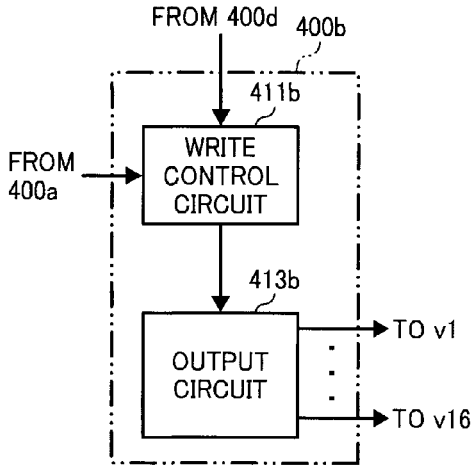
FIG. 8A and FIG. 8B are diagrams illustrating a drive circuit of FIG. 7.

The drive circuit 400*b*, as shown in FIG. 8A, includes a write control circuit 411*b* and an output circuit 413*b*.

The write control circuit 411*b*, when detecting the beginning of a scan based on output signals of a not-illustrated synchronization sensor, superimposes data from the image processing circuit 400*a* with pixel clock signals from the pixel clock generation circuit 400*d* and generates independent modulation data for each light-emitting part v1 through v16.

The output circuit 413*b*, based on the modulation data from the write control circuit 411*b*, generates driving signals to drive each light-emitting part v1 through v16 and outputs to the light source 14A.

Figure 8B:
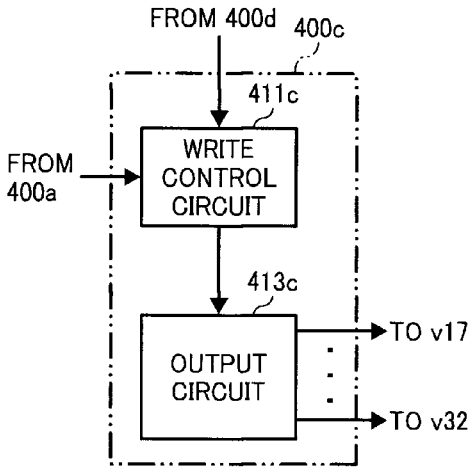

The drive circuit 400*c*, as shown in FIG. 8B, includes a write control circuit 411*c* and an output circuit 413*c*.

The write control circuit 411*c*, when detecting the beginning of a scan based on output signals of a not-illustrated synchronization sensor, superimposes data from the image processing circuit 400*a* with pixel clock signals from the pixel clock generation circuit 400*d* and generates independent modulation data for each light-emitting part v17 through v32.

The output circuit 413*c*, based on the modulation data from the write control circuit 411*c*, generates driving signals to drive each light-emitting part v17 through v32 and outputs to the light source 14A.

Figure 9:
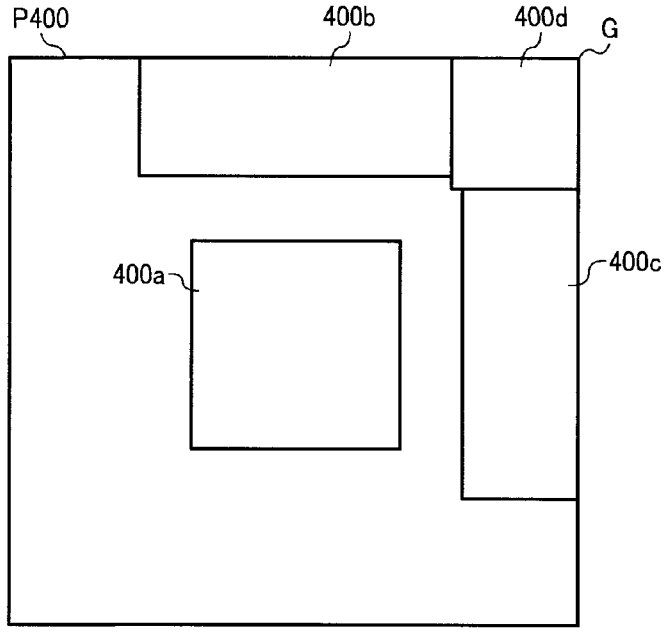
FIG. 9 is a diagram illustrating an arrangement of each drive circuit.

As shown in FIG. 9 as an example, the image processing circuit 400*a*, the two drive circuits (400*b*, 400*c*) and the pixel clock generation circuit 400*d* are mounted on a substrate P400 of a quadrangular shape.

Hereby, the image processing circuit 400*a* is disposed in approximately the center of the substrate P400. The two drive circuits (400*b*, 400*c*) are disposed in the vicinity of the two sides that form a corner (for convenience, referred to as "corner G" hereinbelow) of the substrate P400. In addition, the pixel clock generation circuit 400*d* is disposed in the vicinity of the corner G of the substrate.

Figure 10:
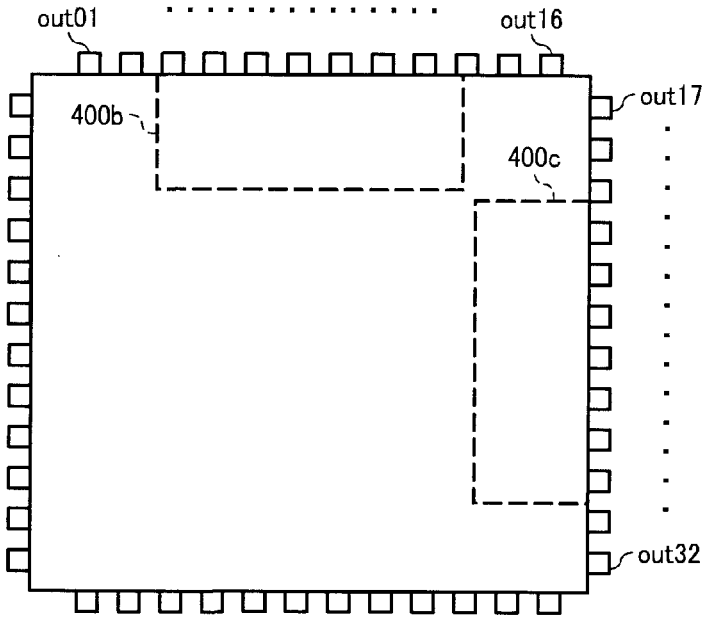
FIG. 10 is a diagram illustrating an output terminal of a driving signal of an IC package.

The substrate P400 in which various circuits are mounted, as shown in FIG. 10 as an example, is contained in a QFP type package. Terminals out01 through out16 close to the drive circuit 400*b* correspond to the light-emitting parts v1 through v16, and are output terminals in which respective driving signals are outputted. In addition, terminals out17 through out 32 close to the drive circuit 400*c* correspond to light emitting part v17 through v32, and are output terminals in which respective driving signals are outputted. That is, the terminals out01 through out16 are output parts of the drive circuit 400*b*, and the terminals out17 through out32 are output parts of the drive circuit 400*c*. For convenience, the package in which the substrate P400 is contained is also termed "IC package" hereinbelow.

Figure 11:
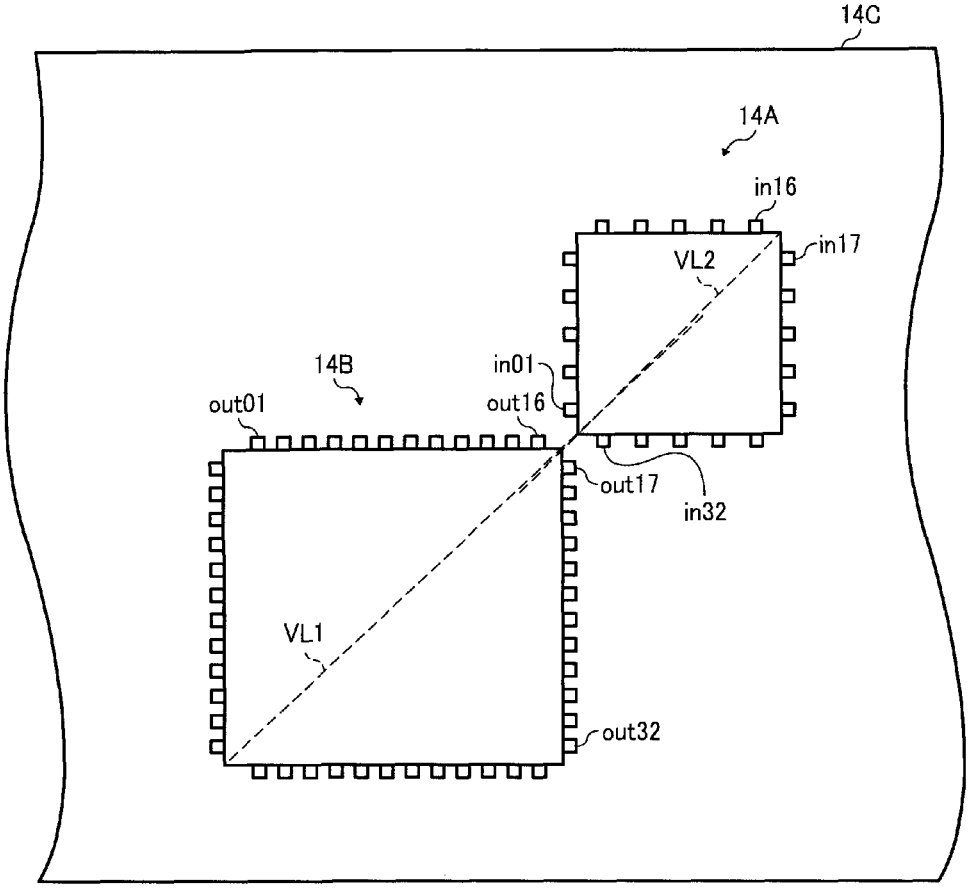
FIG. 11 is a diagram illustrating a positional relationship between an IC package and a light source package.

As shown in FIG. 11 as an example, the control circuit 14B and the light source 14A are disposed so that a virtual line VL1 obtained by extending a diagonal line that passes through at least the corner G of the substrate P400 approximately matches a virtual line VL2 obtained by extending a diagonal line of the light source 14A.

Figure 12:
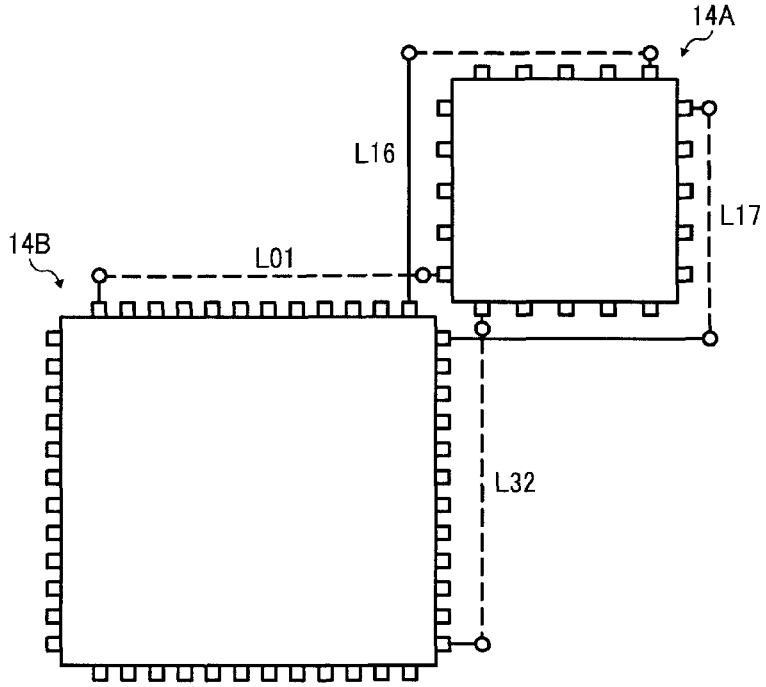
FIG. 12 is a diagram illustrating wiring lines, each of which connects between an IC package and a light source package.

The terminals out01 through out32 of the IC package and the terminals in01 through in32 of the light source package are electrically connected by the wiring lines L01 through L32 (refer to FIG. 12). Only a portion of the wiring lines are illustrated in FIG. 12. The solid line part and the dashed line part of FIG. 12 show the wiring lines passing in different layers from each other. Each circle mark illustrates a via hole. Variations in length of the wiring lines are smaller than conventional cases.

Figure 13:
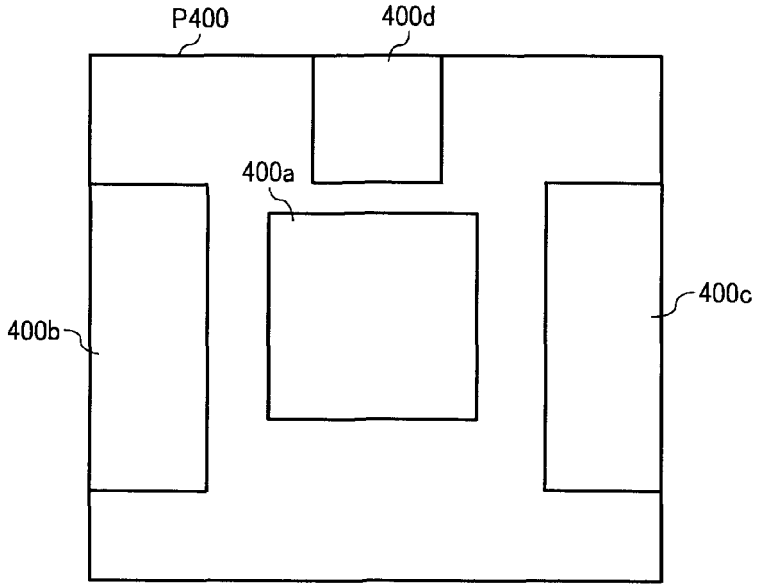
FIG. 13 is a diagram illustrating a conventional arrangement of each drive circuit.
Figure 14:
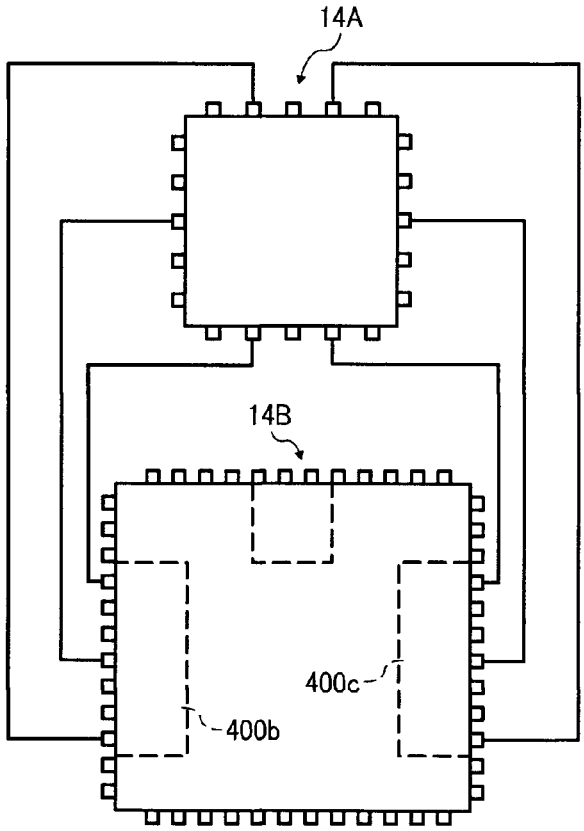
FIG. 14 is a diagram illustrating a conventional positional relationship between an IC package and a light source package.

Two drive circuits (400*b*, 400*c*) disposed mutually facing are illustrated in a conventional example shown in FIG. 13. In this case, as shown in FIG. 14, variations in length of the wiring lines are large.

Incidentally, in general, pins of the IC package and the light source package having parasitic capacity are used. Also, the wiring line itself that electrically connects between the IC package and the light source package has coupling capacity due to wiring width or wiring pattern and so on. Thereby, even in the case when an ideal rectangular-shaped current (or voltage) is generated within the drive circuit, an RC circuit is constituted due to the coupling capacity and the resistance component of the light-emitting part. Therefore, a decay of a portion of time constant $\tau$ calculated by $r=R\times C$ is generated in a wave shape current at a light-emitting level, which is supplied to the light-emitting part.

The above time constant is not substantially different with regard to the pin to pin of the IC package and the pin to pin of the light source package, but the length of each wiring line can not always be equal because of constraints on the substrate so that the possibility of each light-emitting part having differing coupling capacities is high.

In addition, a light source having a two-dimensional array of VCSELs is used as a light source having a plurality of light-emitting parts, and because of the disposition pattern of the plurality of light-emitting parts or variations of the device and so on, it is conceivable that resistance components between light-emitting parts differ.

Because the value of the time constant changes according to resistance and capacity, variations in upstroke properties of the light-emitting level current supplied to each light-emitting part are generated so that the variations form an optical waveform. Accordingly, when the light source unit is used in a light-scanning device, variations in scan light quantity are generated. In addition, when the light source unit is used in an image-forming apparatus, concentration unevenness is generated, and thereby the formation of a high quality image becomes difficult.

Figure 15:
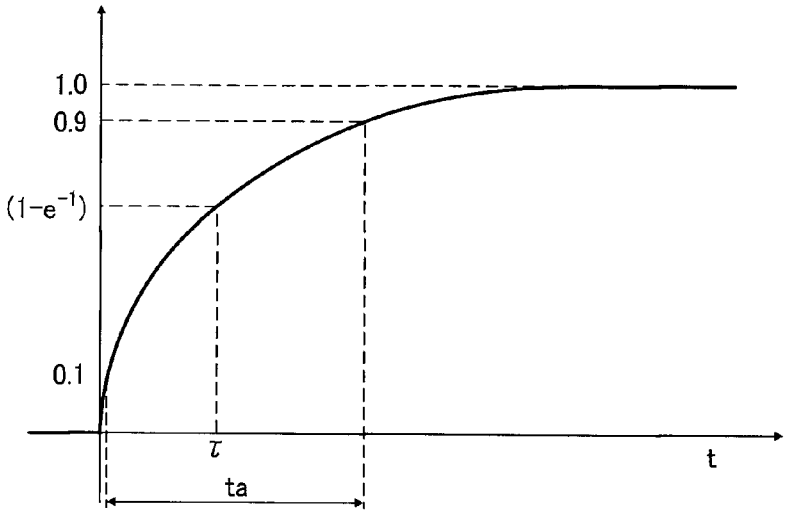
FIG. 15 is a diagram illustrating a relationship between time constant and upstroke properties.

Incidentally, in FIG. 15, a comparative diagram of the time constant and the upstroke properties is illustrated. For example, in the case where a constant current in a pulsed shape is applied, when the absolute value is set to 1, the time constant $\tau$ illustrates the time when the magnitude of electrical current becomes $(1-e^{-1})$. On the other hand, in the case when the upstroke properties are calculated by a 10-90% method, the upstroke time ta illustrates the time when the magnitude of the electrical current changes from 0.1 to 0.9. When considering the response characteristics with regard to the pulsed shape waveform, it is easy to understand by considering the upstroke properties that the relationship between the upstroke properties and the time constant can be calculated by a relational formula of both, yielding upstroke time $ta=2.2\times\tau$. This also applies to downstroke time.

Figure 16A:
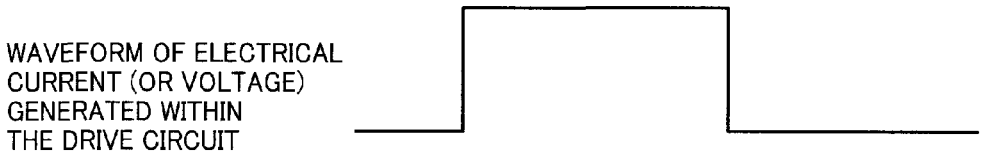
FIG. 16A is a waveform diagram of an electrical current (or voltage) generated within a drive circuit.
Figure 16B:
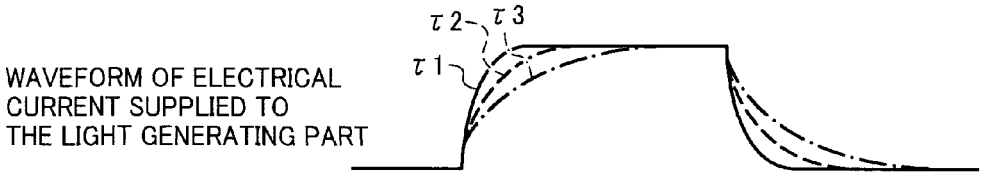
FIG. 16B is a waveform diagram of an electrical current supplied to a light-emitting part.

FIG. 16A schematically illustrates a waveform of an electrical current (or voltage) generated within the light source driver. FIG. 16B schematically illustrates a waveform of an electrical current supplied to the light-emitting part through the wiring line. For example, the wiring lines are set such that the length of the wiring line L1<the length of the wiring line L2<the length of the wiring line L3. In the case where the capacity of the IC pin, the capacity of the light source pin and the resistance component of the light-emitting part of each light-emitting part are almost the same as each other, the waveform of the electrical current supplied to the light-emitting part through the shortest wiring line has the best upstroke property and that through the longer wiring line generates more waveform deviation.

According to the present embodiment, variations in length of the wiring lines are small so that the waveforms of electrical currents supplied to each light-emitting part become approximately the same.

According to the present embodiment, the light source 14A, the control circuit 14B and the light-receiving element 14H are mounted on the PCB14C.

Referring back to FIG. 2, the opening plate 23 has an opening part that prescribes a beam diameter of at least the Z axial direction of light via the coupling lens 15.

The cylindrical lens 17 images the light that has passed through the opening part of the opening plate 23 via the reflective mirror 18 in the vicinity of a deflecting reflective surface of the polygon mirror 13 with regard to a Z axial direction.

Incidentally, an optical system disposed on an optical path between the light source 14A and the polygon mirror 13 is referred to as a before deflector optical system. According to the present embodiment, the before deflector optical system is constituted by the coupling lens 14E, the opening plate 23, the cylindrical lens 17 and the reflective mirror 18.

The polygon mirror 13 has a quadruple mirror and each mirror forms deflecting reflective surfaces. The polygon mirror 13 rotates at an equal speed around a rotating axis parallel to the Z axial direction and deflects the light entering via the reflective mirror 18.

The scan lens 11*a* on the deflector side is disposed on an optical path of the light deflected by the polygon mirror 13.

The scan lens 11*b* on the image plane side is disposed on an optical path of the light via the scan lens 11*a* on the deflector side.

An optical system disposed on an optical path between the polygon mirror 13 and the photoreceptor drum 1030 is also referred to as a scan optical system. According to the present embodiment, the scan optical system is constituted by the scan lens 11*a* on the deflector side and scan lens 11*b* on the image plane side.

The light deflected by the polygon mirror 13 is imaged by the scan optical system and collected to the surface of photoreceptor drum 1030 as a light spot.

Therefore, accompanying the rotation of the polygon mirror 13, the light spot on the surface of the photoreceptor drum 1030 moves in the Y axial direction. Hereby, the movement direction of the light spot is the main scanning direction.

As is clear from the above descriptions, in the light-scanning device 100 according to the present embodiment, the light source driver is constituted by the control circuit 14B.

In addition, the light source device is constituted by the light source 14A, the control circuit 14B and wiring lines L01 through L32.

As described above, in the light-scanning device 100 according to the present embodiment, the light source unit 14 includes the light source 14A having the plurality of light-emitting parts and the control circuit 14B that controls the light source 14A. The output parts of the two drive circuits (400*b*, 400*c*) of the control circuit 14B are disposed in the vicinity of the two sides that form the corner G of the substrate. In addition, the control circuit 14B and the light source 14A are disposed so that the virtual line VL1 obtained by extending the diagonal line passing through the at least one corner of the substrate P400 approximately corresponds to the virtual line VL2 obtained by extending the diagonal line of the light source 14A. Output parts of the drive circuits and input parts of the light source 14A disposed on the same side against the virtual line are connected by a plurality of wiring lines. That is, the plurality of output parts of the plurality of output parts of the light source driver, which are disposed on one side of the virtual line are connected to the plurality of input parts of the plurality of input parts of the light source, which are disposed on the one side of the virtual line. The plurality of output parts of the plurality of output parts of the light source driver, which are disposed on the other side of the virtual line are connected to a plurality of input parts of the plurality of input parts of the light source, which are disposed on the other side of the virtual line. Thereby, in the plurality of wiring lines that electronically connect the control circuit 14B and the light source 14A, variations in length of the wiring lines become small. Therefore, the upstroke properties of each light-emitting part can be mutually approximately equal and as a result, light scanning of high precision becomes possible without increasing the cost.

In addition, in the light-scanning device 100 according to the present embodiment, because the pixel clock generation circuit 400*d* is disposed in the vicinity of the corner G, the distances between each drive circuit and the pixel clock generation circuit 400*d* are shorter than in conventional cases, so that it is possible to control the delay of pixel clock signals.

Figure 17:
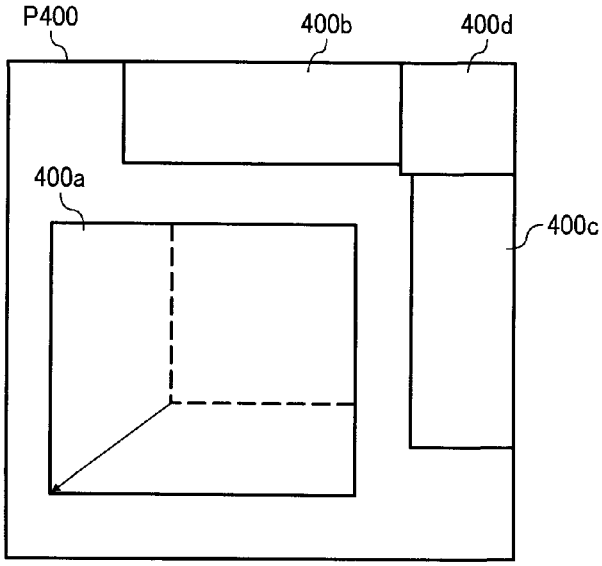
FIG. 17 is a diagram illustrating an increase of an image processing circuit.

In addition, in the light-scanning device 100 according to the present embodiment, as shown in FIG. 17 as an example, it is not necessary to change the layout even when the image processing circuit 400*a* becomes larger in size.

In addition, in the light-scanning device 100 according to the present embodiment, signal lines between the image processing circuit 400*a* and each drive circuit have cross points with signal lines between the pixel clock generation circuit 400*d* and each drive circuit. Hereby, the cross points can be lessened so that it is possible to control the degradation of the pixel clock signals.

In addition, the laser printer 1000 according to the present embodiment includes the light-scanning device 1010 which is able to perform high precision light scanning without increasing the cost. As a result, it is possible to form with high speed a high quality image without incurring higher cost.

Figure 18:
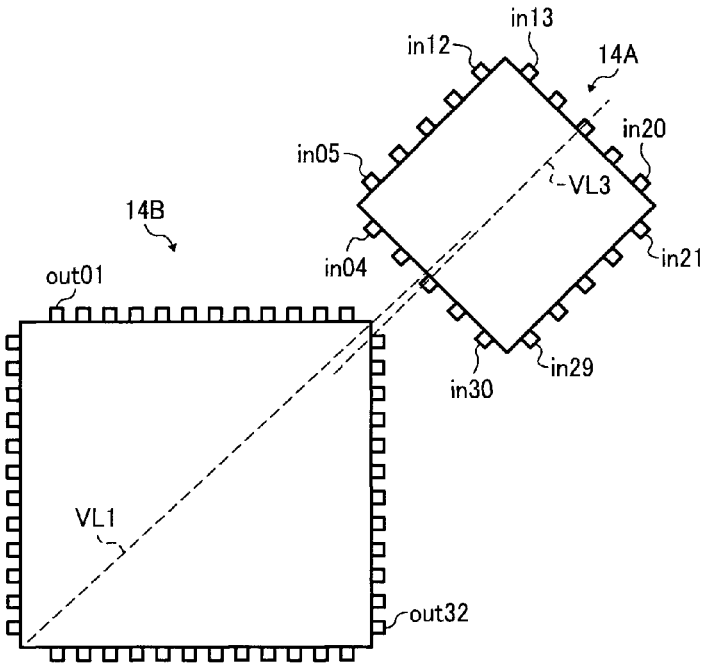
FIG. 18 is a diagram illustrating a modified example of a positional relationship between an IC package and a light source package.

In the above embodiment, as shown in FIG. 18 as an example, the control circuit 14B and the light source 14A can be disposed so that the virtual line VL1 obtained by extending the diagonal line passing through the corner G of the substrate P400 approximately corresponds to the virtual line VL3 obtained by extending one of the lines each of which connects a pair of midpoints of the two sides of the light source 14A, which face each other. The same effects as the above embodiment can also be obtained in this case.

Figure 19A:
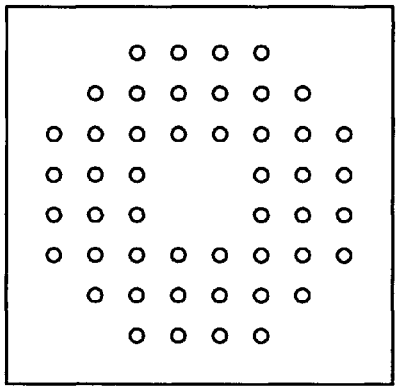
FIG. 19A is a diagram illustrating a modified example of an IC package.
Figure 19B:
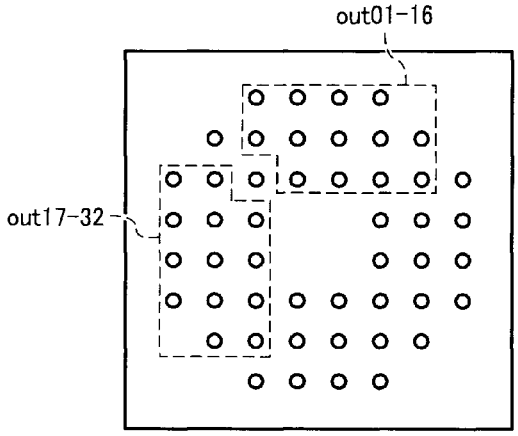
FIG. 19B is a diagram illustrating output terminals in the IC package of FIG. 19A.

In addition, in the above embodiment, the case is possible where the substrate P400, mounted with various circuits, is contained in a QFP type package, but it is not limited to such. For example, as shown in FIG. 19A, it can also be contained in a BGA type package. In this case, as shown in FIG. 19B, of the plurality of terminals, the plurality of terminals disposed in a position close to each drive circuit are set as output terminals of signals to the light source 14A or the substrate thereof so that the same effects as the above embodiment can be obtained.

In the above embodiment, the case in which the light emitting part is VCSEL is described, but it is not limited thereto. For example, the light-emitting part can be a red LD. Because the red LD has a large internal resistance, especially beneficial effects can be expected.

In addition, in the above embodiment, the case in which the light source 14A has 32 light-emitting parts is described, but it is not limited thereto. The light source is only required to have a plurality of light-emitting parts. The arrangement of the plurality of light-emitting parts can be one-dimensional.

In addition, in the above embodiment, the case of the laser printer 1000 as the image forming apparatus is described, but it is not limited thereto. That is, if an image-forming apparatus that includes the light scanning device 1010 is used, then it is possible to form with high speed a high quality image without incurring higher cost.

In addition, an image-forming apparatus can include the light-scanning device 1010 and directly irradiate laser beams to a media (for example, paper) which can be colored by the laser beams.

In addition, an image-forming apparatus can use a silver salt film as an image carrier. In this case, a latent image is formed on the silver salt film by light scanning and this latent image can be visualized by the same processing as an image development processing of the normal silver salt photography process. And the latent image can be transferred to photographic printing paper by the same processing as an anneal printing process of a normal silver salt photography process. An image-forming apparatus as such can be applied as a light-print making device or a light-drawing device that draws a CT scan image or the like.

Figure 20:
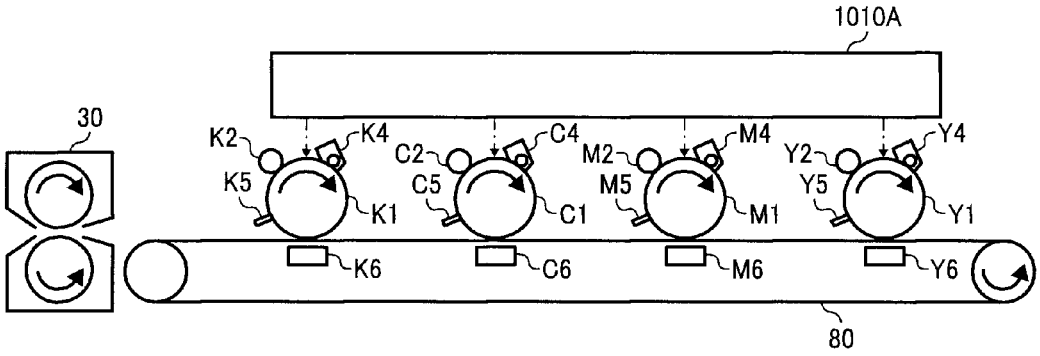
FIG. 20 is a diagram illustrating an approximate constitution of a tandem color machine.

In addition, as shown in FIG. 20 as one example, the image-forming apparatus can be a tandem color machine corresponding to a color image and including a plurality of photoreceptor drums. The tandem color machine includes a photoreceptor drum K1 for black (K), a charger K2, an image development device K4, a cleaning measure K5 and a charge measure K6 for transfer, a photoreceptor drum C1 for cyan (C), a charger C2, an image development device C4, a cleaning measure C5 and a charge measure C6 for transfer, a photoreceptor drum M1 for magenta (M), a charger M2, an image development device M4, a cleaning measure M5 and a charge measure M6 for transfer, a photoreceptor drum Y1 for yellow (Y), a charger Y2, an image development device Y4, a cleaning measure Y5 and a charge measure Y6 for transfer, a light-scanning device 101A, a transfer belt 80 and a fixing measure 30 and so on.

The light-scanning device 1010A includes a light-emitting part for black, a light-emitting part for cyan, a light-emitting part for magenta and a light-emitting part for yellow.

Then, the light from the light-emitting part for black is emitted onto the photoreceptor drum K1 via a scan optical system for black, the light from the light-emitting part for cyan is emitted onto the photoreceptor drum C1 via a scan optical system for cyan, the light from the light-emitting part for magenta is emitted onto the photoreceptor drum M1 via a scan optical system for magenta, the light from the light-emitting part for yellow is emitted onto the photoreceptor drum Y1 via a scan optical system for yellow. A light-scanning device 1010 in each color may be included.

Each photoreceptor drum rotates in a direction of an arrow within FIG. 20. A charger, an image development device, a charge device for transfer and a cleaning device are disposed in the order of rotation. Each charger uniformly charges the surface of the corresponding photoreceptor drum. Beams are emitted by the light scanning device 1010A to the surface of the photoconductive drum charged by the charger so that an electrostatic latent image is formed on the photoconductive drum. Then, a toner image is formed on the surface of the photoconductive drum by a corresponding image development device. Furthermore, by a corresponding charge device for transfer, the toner images of each color are transferred to recording paper and finally an image is fixed to the recording paper by a fixing device 30.

As described above, the light source driver according to an embodiment of the present invention is suited for controlling the variations in length of the plurality of wiring lines without incurring higher cost. In addition, the light source driver according to an embodiment of the present invention is suited to mutually equalizing the upstroke properties of the plurality of light sources without incurring higher cost. In addition, a light-scanning device according to an embodiment of the present invention is suited to performing light scanning with high precision without incurring higher cost. In addition, an image-forming apparatus according to an embodiment of the present invention is suited to forming with high speed a high quality image without incurring higher cost.

According to another aspect of the present invention, there is provided a light source device that is able to mutually equalize upstroke properties when the plurality of light-emitting bodies emit light, without incurring higher cost.

According to still another aspect of the present invention, there is provided a light-scanning device that is able to perform light scanning with high precision without incurring higher cost.

According to still another aspect of the present invention, there is provided an image-forming apparatus that is able to form a high quality image with high speed without incurring higher cost.

Accordingly, any of the plurality of wiring lines that electronically connect between the plurality of light-emitting bodies and the plurality of output parts can be extended in approximately the same direction. As a result, it is possible to control the variation in length of the plurality of wiring lines.

According to still another aspect of the present invention, there is provided a light source device including a light source wherein the plurality of light-emitting bodies and the plurality of input parts in which driving signals to drive the plurality of light-emitting bodies are inputted are mounted on a first substrate of a quadrangular shape; a light source driver according to an embodiment of the present invention mounted on a second substrate of a quadrangular shape having a plurality of output parts which output driving signals to drive the plurality of light-emitting bodies; and a plurality of wiring lines that electronically connect the plurality of input parts and the plurality of output parts; wherein the first substrate is disposed so that it is approximately bisected by the virtual line obtained by extending the diagonal line passing through the pair of corners of the second substrate.

Accordingly, a light source driver according to an embodiment of the present invention has a plurality of output parts in the vicinity of the two sides of the second substrate, which form a corner of the second substrate. The first substrate is disposed so that it is approximately bisected by the virtual line obtained by extending the diagonal line passing through at least one corner of the second substrate. In this case, variations in the length of the plurality of wiring lines which electronically connect the plurality of input parts and the plurality of output parts can be reduced. Thereby, upstroke properties when the plurality of light-emitting bodies emit light can be mutually equalized without incurring higher cost.

According to still another aspect of the present invention, there is provided a light-scanning device that scans a surface to be scanned by light. The light-scanning device includes a light source device of the present invention; a deflector that deflects light from the light source device; a scan optical system that collects light deflected by the deflector on the surface to be scanned.

Accordingly, because the light-scanning device includes a light source device according to an embodiment of the present invention, as a result, high precision light-scanning becomes possible without incurring higher cost.

According to still another aspect of the present invention, there is provided an image forming apparatus including at least one image carrier; at least one light-scanning device of the present invention that scans the at least one image carrier with light in which the image information is contained.

Accordingly, because the image-forming apparatus includes at least one light-scanning device of the present invention, as a result, high quality images can be formed at high speed without incurring higher cost.

Although the preferred embodiments of the present invention have been described, it should be understood that the present invention is not limited to these embodiments, and various changes and modifications can be made to the embodiments.

What is claimed is:

1. A light source device, comprising:

a light source in which a plurality of light-emitting bodies and a plurality of input parts to which driving signals to drive the plurality of light-emitting bodies are inputted, are mounted on a first rectangular-shaped substrate; and a light source driver mounted on a second rectangular-shaped substrate, wherein the light source driver includes a clock generation circuit that is disposed in a vicinity of one corner of the second substrate and generates standard clocks of the driving signals of the plurality of light-emitting bodies positioned at the one corner of the second substrate, a first drive circuit that is disposed in a vicinity of one side of two sides forming the one corner and generates a part of the driving signals of the plurality of light-emitting bodies, a second drive circuit that is disposed in a vicinity of the other side of the two sides and generates one or more others of the driving signals of the plurality of light-emitting bodies, a plurality of first output parts that are disposed in a vicinity of the one side and that output a part of the driving signals of the plurality of light-emitting bodies, and a plurality of second output parts that are disposed in a vicinity of the other side of the two sides and generates the residual of the driving signals of the plurality of light-emitting bodies, wherein the first substrate is divided by a virtual line obtained by extending a diagonal line that passes through one corner of the second substrate into substantially two equal parts, wherein the plurality of first output parts of the light source driver are disposed on one side of the virtual line and connected to a plurality of input parts of the plurality of input parts, which are disposed on the one side of the virtual line, and wherein the plurality of second output parts of the light source driver are disposed on the other side of the virtual line and connected to a plurality of input parts of the plurality of input parts, which are disposed on the other side of the virtual line.

2. A light source driver according to claim 1, wherein the second substrate is contained in a QFP type package.

3. A light source driver according to claim 1, wherein the second substrate is contained in a BGA type package having a plurality of terminals and of the plurality of terminals, a plurality of terminals disposed in the vicinity of the one side of the substrate are the plurality of first output parts, and of the plurality of terminals, a plurality of terminals disposed in the vicinity of the other side of the substrate are the plurality of second output parts.

4. A light source device according to claim 1, wherein the virtual line obtained by extending the diagonal line passing through the pair of corners of the second substrate substantially corresponds to the virtual line obtained by extending a diagonal line of the first substrate.

5. A light source device according to claim 1, wherein the virtual line obtained by extending the diagonal line that passes through the at least one corner of the second substrate substantially corresponds to a virtual line obtained by extending one of lines, each of which connects a pair of midpoints of two sides of the first substrate, the two sides of the first substrate facing each other.

6. A light-scanning device that scans a surface to be scanned by light beams, comprising:

the light source device according to claim 1;

a deflector that deflects light from the light source device; and a scan optical system that collects the light deflected by the deflector on the surface to be scanned.

7. An image-forming apparatus, comprising:

at least one image carrier;

at least one light-scanning device according to claim 6 that scans the at least one image carrier with light in which image information is contained.

8. An image-forming apparatus according to claim 7, wherein the image information is multi color image information.

* * * * *